US008573747B2

(12) United States Patent
Jilani et al.

(10) Patent No.: US 8,573,747 B2
(45) Date of Patent: Nov. 5, 2013

(54) ELECTROSTATIC LIQUID-EJECTION ACTUATION MECHANISM

(75) Inventors: Adel Jilani, Corvallis, OR (US); Jun Zeng, Corvallis, OR (US); Kenneth James Faase, Corvallis, OR (US); Tony S. Cruz-Uribe, Corvallis, OR (US); Michael G. Monroe, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 141 days.

(21) Appl. No.: 13/119,601

(22) PCT Filed: Oct. 31, 2008

(86) PCT No.: PCT/US2008/082144
§ 371 (c)(1),
(2), (4) Date: Mar. 17, 2011

(87) PCT Pub. No.: WO2010/050982
PCT Pub. Date: May 6, 2010

(65) Prior Publication Data
US 2011/0169894 A1 Jul. 14, 2011

(51) Int. Cl.
*B41J 2/04* (2006.01)

(52) U.S. Cl.
USPC ..... 347/54; 347/70

(58) Field of Classification Search
USPC ..... 347/20, 54, 55, 68, 70, 71
See application file for complete search history.

(56) References Cited

U.S. PATENT DOCUMENTS

| | | | |
|---|---|---|---|
| 5,171,132 | A | 12/1992 | Miyazaki et al. |
| 5,424,769 | A | 6/1995 | Sakai et al. |
| 5,894,316 | A | 4/1999 | Sakai et al. |
| 5,992,978 | A | 11/1999 | Fujii et al. |
| 6,113,218 | A | 9/2000 | Atobe et al. |
| 6,190,003 | B1 | 2/2001 | Sato et al. |
| 6,273,558 | B1 | 8/2001 | Kitahara |
| 6,302,531 | B1 | 10/2001 | Usui et al. |
| 6,315,400 | B1 | 11/2001 | Sakai et al. |
| 6,322,198 | B1 | 11/2001 | Higashino et al. |
| 6,343,852 | B1 | 2/2002 | Yoon |

(Continued)

FOREIGN PATENT DOCUMENTS

| | | |
|---|---|---|
| EP | 0519403 | 12/1995 |
| EP | 1185141 | 3/2002 |

(Continued)

OTHER PUBLICATIONS

Supplementary European Search Report for Application No. EP08877897.2. Report issued Jul. 19. 2012.

*Primary Examiner* — Juanita D Jackson

(57) ABSTRACT

An electrostatic liquid-ejection actuation mechanism includes a membrane, a frame, and one or more deformable beams. The frame has two sides and a number of cross members that are non-parallel to the two sides. The two sides and the cross members define one or more areas individually corresponding to one or more liquid chambers. The deformable beams are disposed between the membrane and the frame. The deformable beams individually correspond to the liquid chambers, and define a number of slits. Each slit is adjacent to one of the two sides of the frame. The deformable beams have a width that is less than a width of the liquid chambers, due at least to the slits.

13 Claims, 8 Drawing Sheets

(56) References Cited

U.S. PATENT DOCUMENTS

| | | | | |
|---|---|---|---|---|
| 6,386,682 | B1 | 5/2002 | Kimura | |
| 6,447,107 | B1 | 9/2002 | Chino et al. | |
| 6,474,784 | B1 | 11/2002 | Fujii et al. | |
| 6,540,339 | B2 | 4/2003 | Cruz-Uribe | |
| 6,609,785 | B2 | 8/2003 | Hashizume et al. | |
| 6,626,525 | B1 * | 9/2003 | Nakamura et al. | 347/70 |
| 6,666,547 | B1 | 12/2003 | Takahashi et al. | |
| 7,100,282 | B2 * | 9/2006 | Kitahara et al. | 347/70 |
| 2003/0016265 | A1 | 1/2003 | Harada et al. | |
| 2005/0069429 | A1 | 3/2005 | Sugahara | |
| 2005/0104941 | A1 | 5/2005 | Tanaka | |
| 2005/0134644 | A1 | 6/2005 | Pasch et al. | |
| 2005/0134645 | A1 | 6/2005 | Okazawa | |
| 2005/0264617 | A1 | 12/2005 | Nishimura et al. | |
| 2006/0056999 | A1 | 3/2006 | East | |
| 2006/0146096 | A1 | 7/2006 | Wright et al. | |
| 2007/0024672 | A1 | 2/2007 | Hano et al. | |

FOREIGN PATENT DOCUMENTS

| | | |
|---|---|---|
| EP | 1640162 | 3/2006 |
| JP | 10016210 | 1/1998 |
| JP | 11291488 | 10/1999 |
| JP | 2001260346 | 9/2001 |
| JP | 2001270112 | 10/2001 |
| JP | 2006035545 | 2/2006 |

* cited by examiner

ELECTROSTATIC LIQUID-EJECTION ACTUATION MECHANISM

BACKGROUND

Inkjet-printing devices, such as inkjet printers, are devices that are able to form images on sheets of media like paper by ejecting ink onto the media sheets. Drop-on-demand inkjet-printing devices primarily include actuation mechanisms based on heat generation, piezoelectric work, or electrostatic attraction. A thermal inkjet printing device ejects ink by heating the ink, which causes formation of a bubble within the ink and results in ink to be ejected. A piezoelectric inkjet printing device ejects ink by deforming a piezoelectric plate, which forces ink to be ejected. An electrostatic inkjet-printing device operates by deforming a membrane with an electrostatic charge between two electrodes. When the electrostatic charge is released, the membrane forcibly ejects ink from the device.

DETAILED DESCRIPTION

Figure 1:
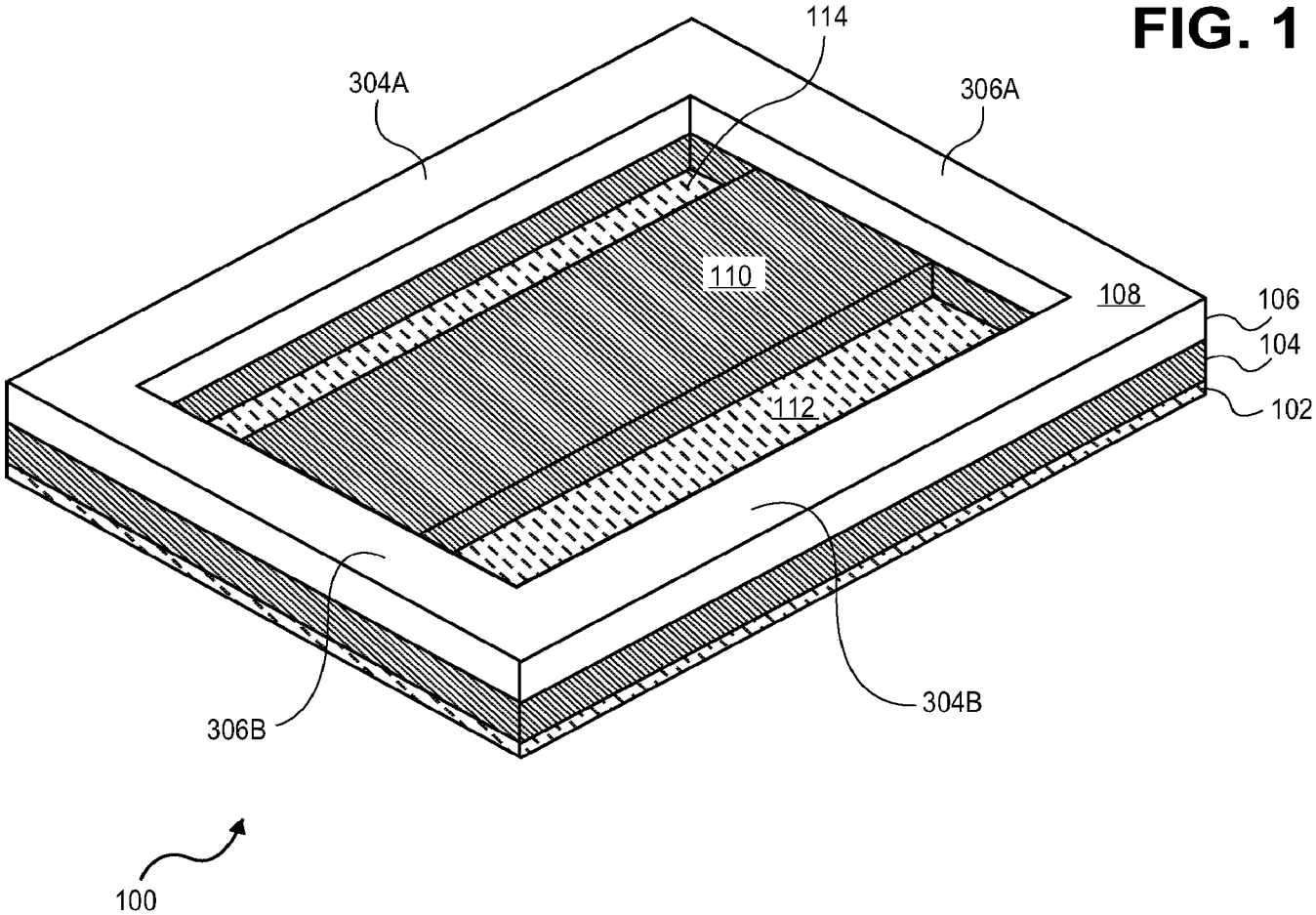
FIG. 1 is a diagram of a perspective view of a portion of an electrostatic liquid-ejection actuation mechanism in detail, according to an embodiment of the present disclosure.
Figure 2:
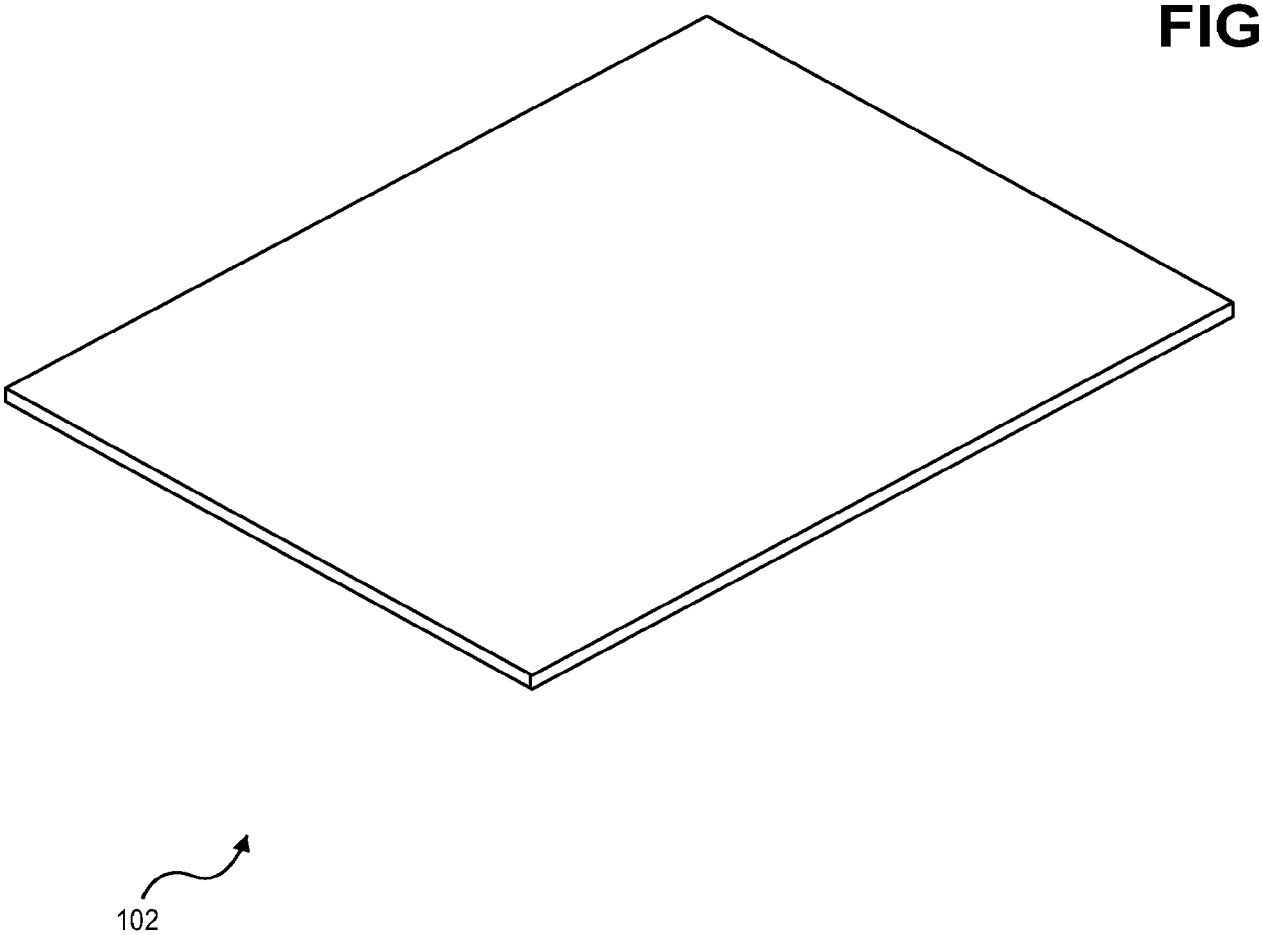
FIGS. 2, 3, and 4 are diagrams of perspective views of the individual layers of the portion of the electrostatic liquid-ejection actuation mechanism of FIG. 1, according to an embodiment of the disclosure.
Figure 3:
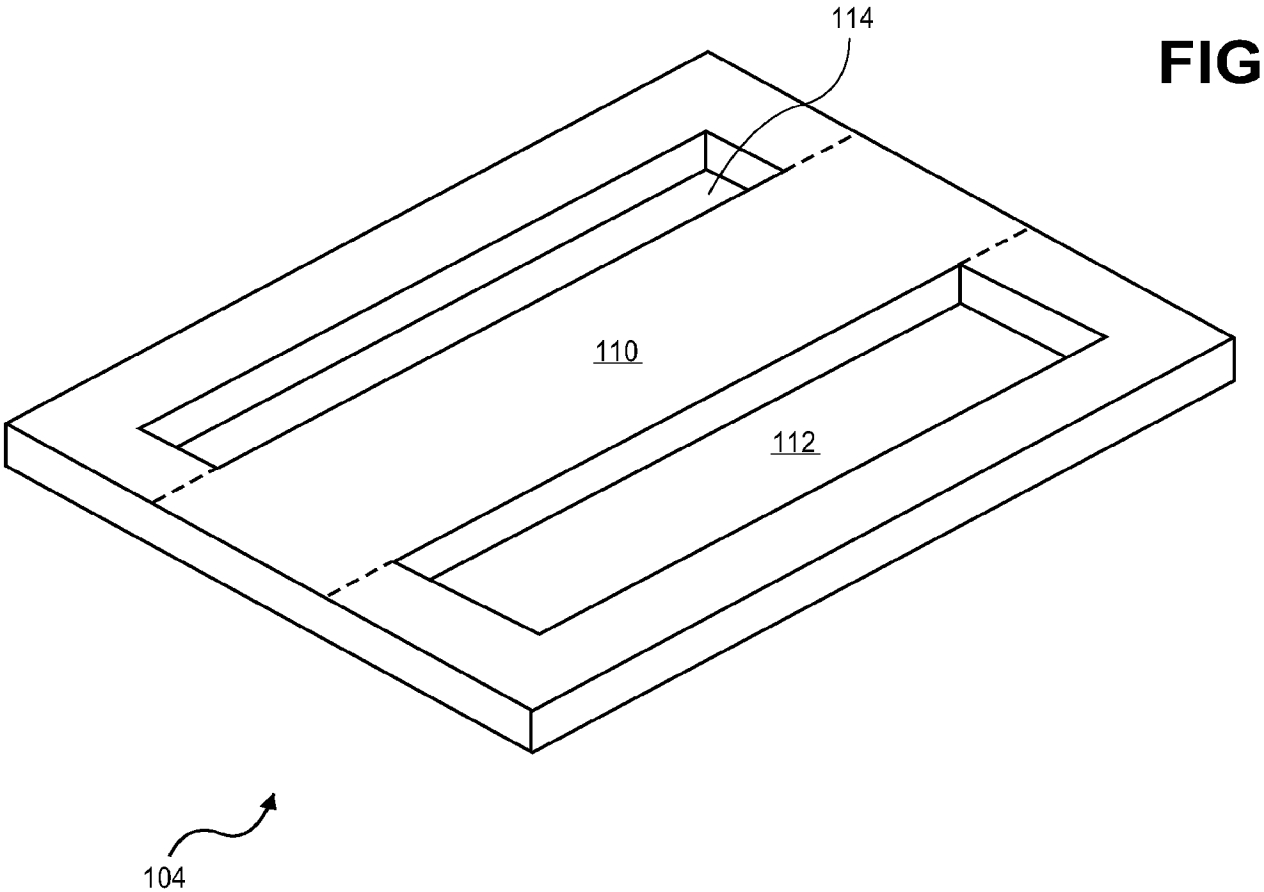
Figure 4:
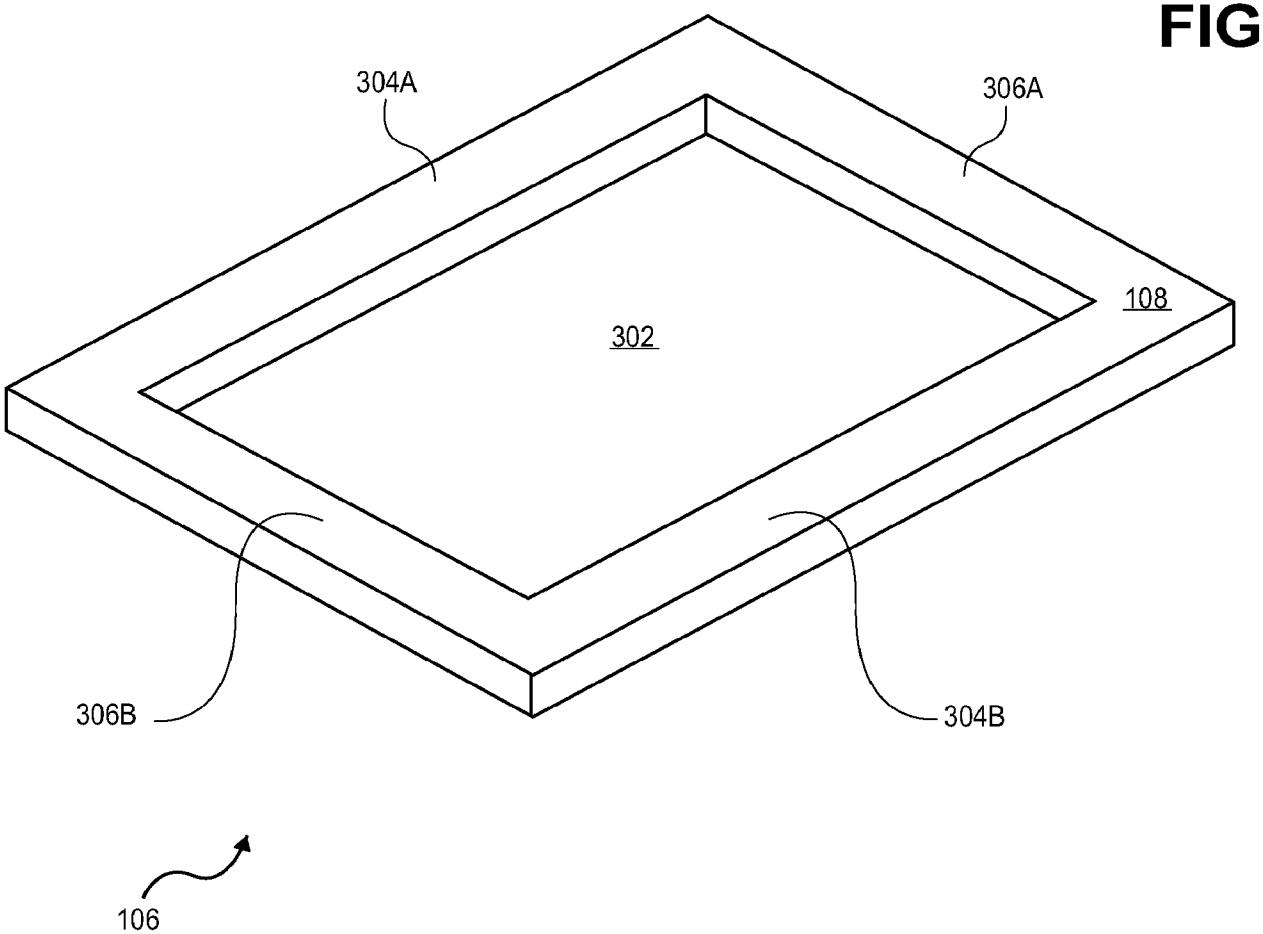

FIG. 1 shows a portion of an electrostatic liquid-ejection actuation mechanism 100, according to an embodiment of the disclosure. The actuation mechanism 100 includes a membrane layer 102, a deformable beam layer 104, and a frame layer 106. FIGS. 2, 3, and 4 individually depict the membrane layer 102, the deformable beam layer 104, and the frame layer 106, respectively. The following description should thus be read with reference to all of FIGS. 1-4. It is noted that the actuation mechanism 100 and the layers 102, 104, and 106 are not drawn to scale in FIGS. 1-4 for illustrative clarity and convenience.

The membrane layer 102 can be fabricated from tantalum-aluminum, and in one embodiment is 0.1 microns in thickness. The membrane layer 102 may also be referred to as simply a membrane, and is flexible. The deformable beam layer 104 can also be fabricated from tantalum-aluminum, and in one embodiment is 3.0 microns in thickness. The frame layer 106 can be fabricated from silicon.

The deformable beam layer 104 includes a single deformable beam 110 in the embodiment of FIGS. 1-4. The deformable beam 110 is deformable in that it is able to flex upwards and/or downwards. As is described in more detail later in the detailed description, the deformable beam 110 acts as one electrode of the electrostatic liquid-ejection actuation mechanism 100. The deformable beam 110 deforms responsive to the attractive force of an electrostatic charge established between itself and another electrode of the actuation mechanism 100. The deformation is towards the other electrode. When the electrostatic charge is released, the deformable beam 110 reverts back to the configuration depicted in FIGS. 1 and 3.

The frame layer 106 includes a frame 108. The frame 108 has a left side 304A and a right side 304B, collectively referred to as the sides 304. The frame 108 further has a number of cross members 306; in the embodiment of FIG. 1, there are two cross members 306A and 306B. The cross members 306 extend from the left side 304A to the right side 304B. The cross members 306 are desirably perpendicular to the sides 304, but are at least non-parallel to the sides 304. The sides 304 and the cross members 306 define a single area 302 in the embodiment of FIGS. 1 and 4. The area 302 corresponds to a (single) liquid chamber of the electrostatic liquid-ejection actuation mechanism 100, as is described in more detail later in the detailed description.

The deformable beam 110 defines slits 112 and 114, where the slit 112 is adjacent to the side 304B of the frame 108, and the slit 114 is adjacent to the side 304A of the frame 108. The slits 112 and 114 are depicted in FIGS. 1 and 3 as being of unequal width, such that the deformable beam 110 is not centered between the sides 304 of the frame 108. However, in another embodiment, the slits 112 and 114 may be of equal width, such that the deformable beam 110 is centered between the sides 304 of the frame 108. The slits 112 and 114 may be five microns each in width in one embodiment.

Figure 5A:
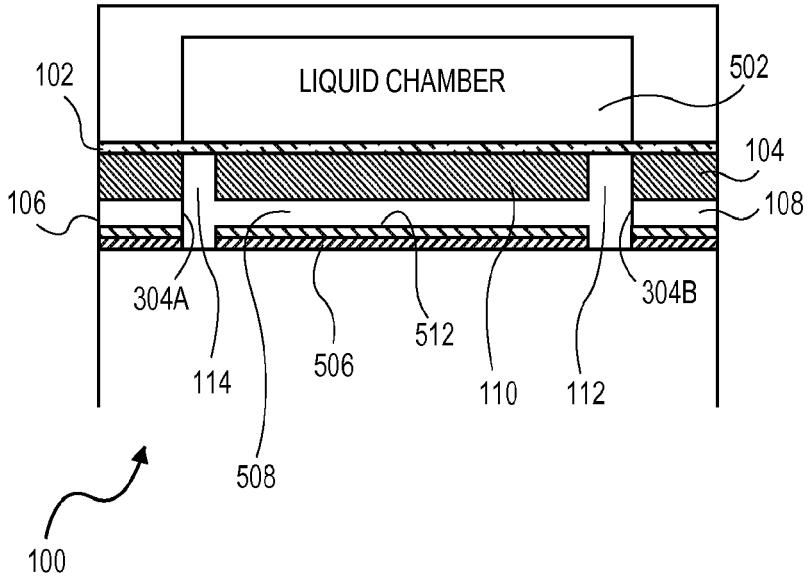
FIGS. 5A and 5B are diagrams of a front cross-sectional view and a side cross-sectional view, respectively, of the portion of the electrostatic liquid-ejection actuation mechanism of FIG. 1, according to an embodiment of the disclosure.
Figure 5B:
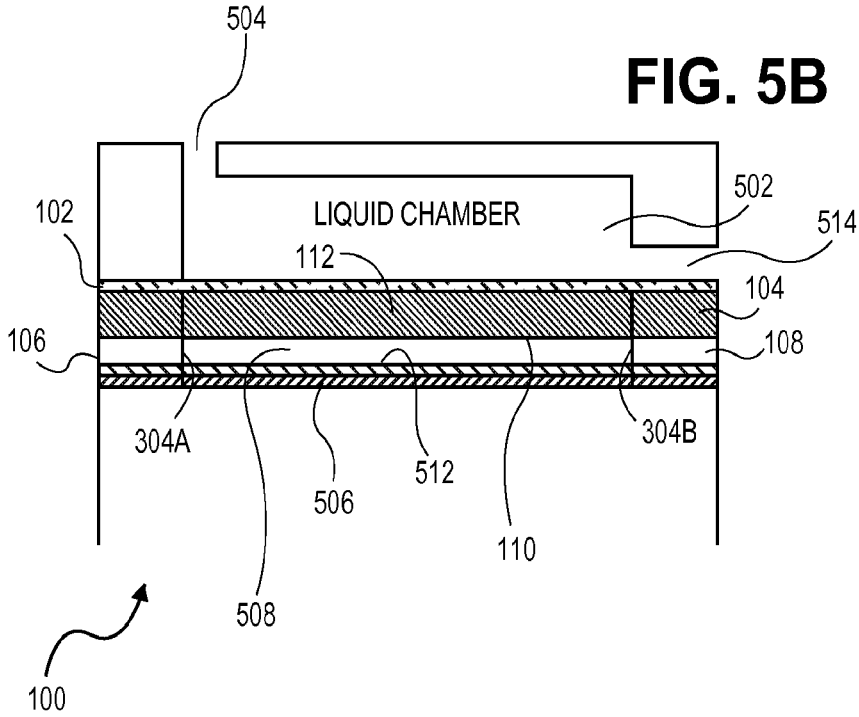

FIGS. 5A and 5B show a front cross-sectional view and a side cross-sectional view, respectively, of the electrostatic liquid-ejection actuation mechanism 100, according to an embodiment of the disclosure. In one embodiment, the width between the sides 304 of the frame 108 of the frame layer 106—that is, the width of the area 302 of FIG. 4—is equal to the width of the liquid chamber 502, but in other embodiments, the width of the area 302 is different than the width of the liquid chamber 502. It is further noted that the width of the deformable beam 110 of the deformable beam layer 104 is less than the width of the liquid chamber 502. This is due at least to the presence of the slits 112 and 114 to either side of the deformable beam 110. The width of the deformable beam 110 may be 50 microns in one embodiment.

Liquid in the liquid chamber 502 is separated from the deformable beam 110 via the membrane layer 102. The liquid chamber 502 includes a liquid-ejection nozzle 504, and also a liquid inlet 514. When the deformable beam 110 deforms responsive to an electrostatic charge, additional liquid is drawn into the liquid chamber 502 via the liquid inlet 514. When the electrostatic charge is released, the deformable beam 110 reverts to its configuration depicted in FIG. 5, and a droplet of liquid is forcibly ejected from the liquid chamber 502 through the liquid-ejection nozzle 504 in response.

In this respect, as has been noted above, the deformable beam 110 serves as one electrode of the electrostatic liquid-ejection actuation mechanism 100. The actuation mechanism 100 also includes an additional electrode 506 and a dielectric 512 such as silicon nitride or tantalum pentoxide. An electrostatic gap 508 is defined between the beam 110 and the electrode 506, and thus encompasses the dielectric 512 and an air space between the dielectric 512 and the beam 110. The electrostatic gap 508 may be 0.6 microns in thickness. The dielectric 512 may have a thickness of 0.4 microns and a dielectric constant between 3 and 28.

It is noted that in FIGS. 5A and 5B, the frame 108 is micromachined from a silicon wafer. Silicon wafers vary in thickness, although 750 microns is typical. Ink feed channels may be etched through the silicon to connect to the liquid inlets, such as the liquid inlet 514. Also, it is noted that the membrane layer 102 has a thickness that is typically ten-to-thirty times thinner than the thickness of the deformable beam 110.

The width of the deformable beam 110 is independent of the width between the sides 304 of the frame 108, and thus is independent of the width of the area 302 defined by the frame 108 as depicted in FIG. 4 as well as being independent of the width of the liquid chamber 502. This independence of the width of the deformable beam 110 is due at least to the defined slits 112 and 114. That is, regardless of the width of the liquid chamber 502 and/or the width between the sides 304 (i.e., the width of the area 302 of FIG. 4), the width of the deformable beam 110 can be independently controlled, by making the slits 112 and 114 bigger or smaller as needed to ensure a desired width of the beam 110.

Having the width of the deformable beam 110 being independent of other widths within the electrostatic liquid-ejection actuation mechanism 100 is advantageous. Electrostatic liquid-ejection actuation using a deformable beam 110 as in FIGS. 1-5 is controlled by how the deformable beam 110 deforms in response to application and release of an electrostatic charge. The characteristics of the deformation of the deformable beam 110 can only be partially controlled by variables relating to the electrostatic charge itself, such as the amount of the charge, how quickly the charge is applied and released, and so on. Rather, the characteristics of the deformation of the deformable beam 110 are more controlled by physical variables relating to the deformable beam 110, such as its modulus, thickness, length, and importantly width.

However, the width of the deformable beam 110 is not typically an independent variable, but is rather usually dependent on the width of the area 302 between the sides 304 of the frame 108 and/or on the width of the liquid chamber 502. One of the inventors' inventive insights is that the dependence of the width of the deformable beam 110 on the width of the area 302 and/or on the width of the liquid chamber 502 should be divorced. As such, the inventors inventively added the slits 112 and 114 to the sides of the deformable beam 110. Because the slits 112 and 114 can be made larger or smaller as desired, the width of the deformable beam 110 is no longer dependent on the width of the area 302 and/or on the width of the liquid chamber 502. Advantageously, this added independence of the width of the deformable beam 110 provides for more control of the characteristics of the deformation of the beam 110, and thus more control over the ejection of liquid droplets from the liquid chamber 502 via the liquid-ejection nozzle 504.

Therefore, in this respect, the inventors' inventive contributions are at least two-fold. First, the inventors recognized that the dependence of the width of the deformable beam 110 on the width of the area 302 and/or on the width of the liquid chamber 502 unduly constricts the characteristics of the deformation of the deformable beam 110 and thus how liquid droplets are ejected from the liquid chamber 502. Second, the inventors novelly invented a specific approach to making the width of the deformable beam 110 independent of the width of the area 302 and/or of the width of the liquid chamber 502, via introduction of the slits 112 and 114 to either side of the deformable beam 110.

Furthermore, the electrostatic liquid-ejection actuation mechanism 100 is inventive in at least a number of other respects. For instance, one such advantage relates to the usage of the deformable beam 110 along with the membrane layer 102 as an actuator, as opposed to just a single uniformly thick layer that is not divided into a beam 110 and a membrane layer 102. All other things being equal—chamber dimensions, gap dimensions, applied voltage, and so on—the volume displaced by a deformable beam 110 and a membrane layer 102 as compared to the volume displayed by a single uniformly thick layer not divided into a beam 110 and a membrane layer 102 can be the same. However, to achieve this, the thickness of the single uniformly thick layer has to be considerably thinner than the thickness of the deformable beam 110.

As a result, the mechanical frequency of oscillation of an actuator made up of a deformable beam 110 and a membrane layer 102 is higher than the mechanical frequency of oscillation of an actuator made up of a single uniformly thick layer. This is advantageous, because the actuator can return to an unstressed (i.e., unactuated) state more quickly when the electrostatic charge has been drained. Therefore, the actuator can be used again sooner to eject additional liquid. As a result, the time between ejected liquid drops is reduced, providing for higher liquid-ejection rates.

Furthermore, the pressure profile for an actuator made up of a deformable beam 110 and a membrane layer 102 is the same or narrower than it is for an actuator made up of a single uniformly thick layer. This is because the actuator made up of a deformable beam 110 and a membrane layer 102 reverts more quickly to the uncharged state. In addition, instead of optimizing the design of the deformable beam 110 for higher frequency, as noted in the previous paragraph, the design can instead be optimized for a lower voltage to build up the electrostatic charge (which would reduce the mechanical frequency of oscillation).

Figure 6:
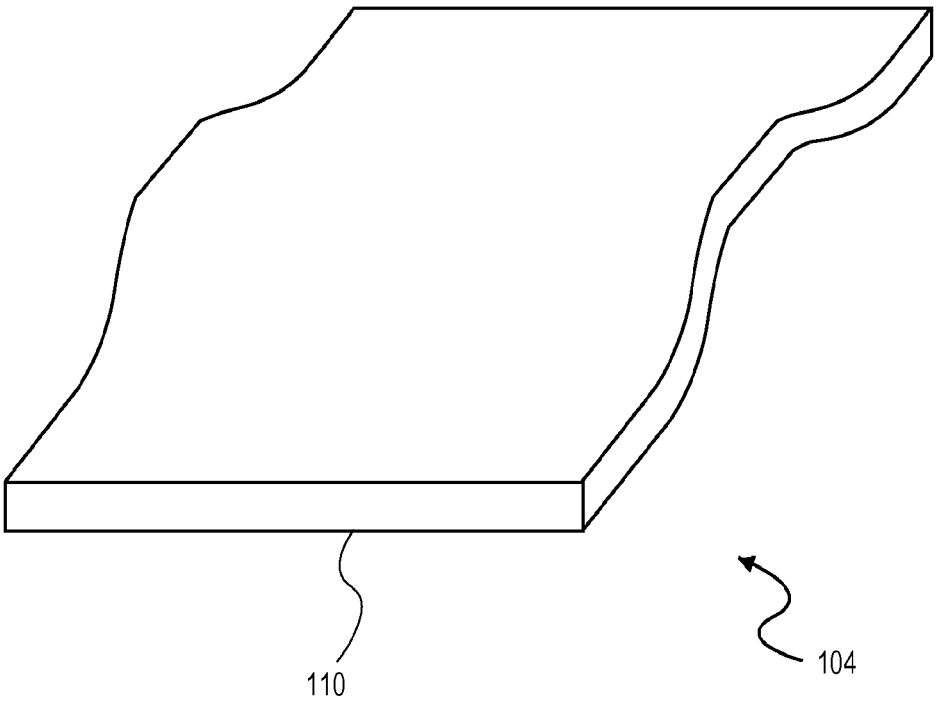
FIG. 6 is a diagram depicting how a beam of an electrostatic liquid-ejection actuation mechanism can deform, according to an embodiment of the disclosure.

FIG. 6 shows a representative deformation of the deformable beam 110 of the deformable beam layer 104 in a snap-down state, according to an embodiment of the disclosure. For illustrative clarity, deformation of the deformable beam 110 is depicted in FIG. 6 "upside down" in relation to FIG. 5. That is, the deformable beam 110 in actuality deforms away from the liquid chamber 502 in FIG. 5, so that additional liquid is drawn into the chamber 502 when an electrostatic charge is established between the beam 110 and the electrode 506 of FIG. 5.

Therefore, when an electrostatic charge is established between the deformable beam 110 and the electrode 506, the beam 110 deforms from a first configuration as depicted in FIGS. 1, 3, and 5 to a second configuration as depicted in FIG. 6. This causes the liquid volume within the liquid chamber 502 to increase through an inlet fluidically coupled to a liquid supply. When the electrostatic charge is released, the deformable beam 110 reverts from the second configuration of FIG. 6 back to the first configuration of FIGS. 1, 3, and 5. This causes a liquid droplet to be ejected from the liquid-ejection nozzle 504 of the liquid chamber 502.

It is noted that snap-down occurs at a point where the electric field strength becomes sufficiently strong to overcome the spring strength of the beam and membrane. The spacing between the beam 110 and the dielectric 512 becomes zero, with the surface of the beam touching the surface of the opposing electrode. The touching portion of the beam is then flat. The shape of the deformable beam 110 depicted in FIG. 6 has been calculated using finite element analysis. Snap-down occurs at a specific voltage pointer, such as around 28 volts in one embodiment. The actuator is ultimately released from a snap-down state.

It is further noted that as has been described thus far, there are two cross members 306 within the frame 108 of the frame layer 106, as in FIG. 4, such that there is a single area 302 defined by the cross members 306 and the sides 304 of the frame 108, as in FIG. 3. Similarly, there is a single liquid chamber 502 in FIG. 5 to which the single area 302 corresponds. There are further just two slits 112 and 114, as in FIGS. 1, 3, and 5, and just a single deformable beam 110 between these two slits 112 and 114, where the left side and the right side single beam 110 are unattached to the frame 108, as in FIG. 3. However, in other embodiments, there may be more than two cross members 306, such that there may be more than one area 302 and there may be more than one liquid chamber 502; likewise, there may be more than one deformable beam 110 and more than two slits 112 and 114. One such additional exemplary embodiment is now described.

Figure 7:
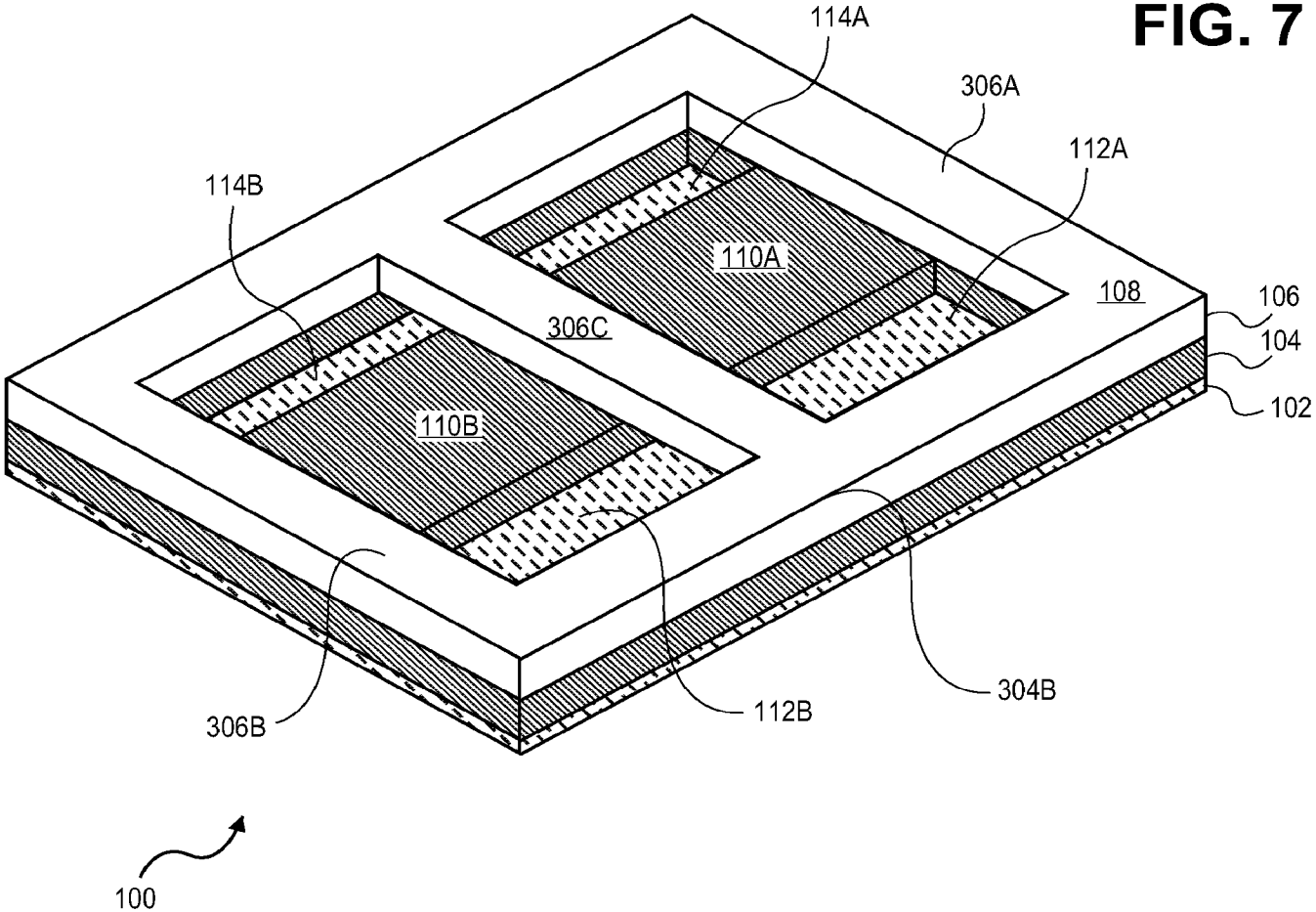
FIG. 7 is a diagram of a perspective view of a partial electrostatic liquid-ejection actuation mechanism in detail, according to another embodiment of the present disclosure.
Figure 8:
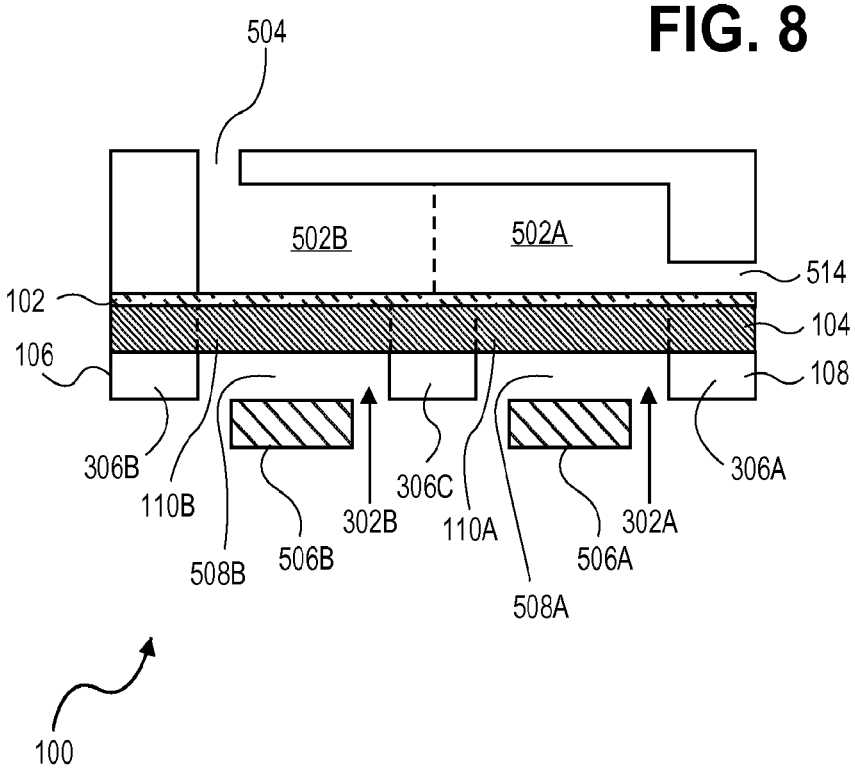
FIG. 8 is a diagram of a side cross-sectional view of the portion of the electrostatic liquid-ejection actuation mechanism of FIG. 7, according to an embodiment of the disclosure.

FIG. 7 shows a perspective view of a portion of an electrostatic liquid-ejection actuation mechanism 100, according to such an additional embodiment of the disclosure. Furthermore, FIG. 8 shows a side cross-sectional view of a portion of the electrostatic liquid-ejection actuation mechanism 100 of FIG. 7, according to an embodiment of the disclosure. The following description should thus be read with reference to both FIG. 7 and FIG. 8. It is noted that FIGS. 7 and 8 are not drawn to scale for illustrative clarity and convenience.

As before, the actuation mechanism 100 includes a membrane layer 102, a deformable beam layer 104, and a frame layer 106. The deformable beam layer 104 includes two deformable beams 110A and 1108, collectively referred to as the deformable beams 110, in this embodiment. The frame 108 of the frame layer 106 has three cross members 306: the cross member 306C, in addition to the cross members 306A and 306B. The cross members 306A and 306B are top and bottom cross members, respectively, whereas the cross member 306C is a middle cross member.

The frame 108 defines two areas 302: an area 302B surrounded by the left and right sides of the frame 108 and by the cross members 306B and 306C, and an area 302A surrounded by the left and right sides of the frame 108 and by the cross members 306A and 306C. The areas 302A and 302B correspond to two liquid chambers 502A and 502B, respectively, of the electrostatic liquid-ejection actuation mechanism 100, and which are collectively referred to as the liquid chamber 502. It can be said that the number of the areas 302 and the number of the corresponding liquid chambers 502 are equal to the number of middle cross members, plus one.

The deformable beams 110 define four slits 112A, 112B, 114A, and 114B, collectively referred to as the slits 112 and 114. The slits 112 are adjacent to the right side of the frame 108, whereas the slits 114 are adjacent to the left side of the frame 108. The width of the beam 110A is control by the width of the slits 112A and 114A, and the width of the beam 110B is controlled by the width of the slits 112B and 114B. The left and the right sides of each of the deformable beams 110 are not attached to the frame 108. The number of deformable beams 110 is thus equal to the number of areas 302 defined by the frame 108, and thus equal to the number of liquid chambers 502.

Each of the deformable beams 110 acts as an electrode. An electrostatic charge is maintained over an electrostatic gap between a given deformable beam 110 and another electrode. For example, in FIG. 8, there are electrodes 506A and 506B corresponding to the deformable beams 110A and 110B. An electrostatic gap 508A is defined between the deformable beam 110A and the electrode 506A, and an electrostatic gap 508B is defined between the deformable beam 110B and the electrode 506B. The electrodes 506A and 506B are collectively referred to as the electrodes 506, and the electrostatic gaps 508A and 508B are collectively referred to as the electrostatic gaps 508. In another embodiment, there may be just one other electrode 506 instead of two electrodes 506, such that the electrostatic gaps 508 are each defined between a corresponding deformable beam 110 and such a single other electrode 506. It is noted that in FIG. 8, the electrostatic gaps 508 are not depicted as including dielectrics as in FIGS. 5A and 5B, but in another embodiment, the gaps 508 can include dielectrics.

Having two deformable beams 110 and two liquid chambers 502 in the embodiment of FIG. 7 can be advantageous over having one deformable beam 110 and one liquid chamber 502 as in the previously described embodiments, as follows. In particular, liquid can be ejected from more than one of the liquid chambers 502 in a coordinated manner so that a single liquid droplet having desired characteristics is ejected from the same liquid-ejection nozzle 504. That is, where the deformable beams 110 are deformed in unison, when they subsequently relax, the beams 110 cause liquid to be ejected from their corresponding liquid chambers 502, out of the same liquid-ejection nozzle 504 to which the chambers 502 are fluidically connected, also in substantial unison. As such, more control over the volume, size, and so on, of the resulting liquid droplet made up of the liquid from all these liquid chambers 502 is provided.

For instance, assume the case where there are N liquid chambers 502, where N is greater than one, and where each liquid chamber 502 can provide for a volume V of liquid. By firing M of the N liquid chambers 502, where M is less than or equal to N, in one embodiment a liquid droplet having a volume of liquid equal to K times V times M can be ejected (assuming that a minimum threshold of volume for liquid ejection has been exceeded), where K is the percentage of liquid displaced by a given actuator mechanism. Since M can be varied, this means that the volume of the liquid droplet that is ejected can be controlled in increments of K times V. As such, larger liquid droplets can be ejected when needed, as well as smaller liquid droplets can be ejected when needed.

It is noted that this scenario is different than simply having different liquid chambers that are to eject different droplets out of different liquid-ejection nozzles. In such instance, each liquid chamber ejects its own droplet. By comparison, in the situation that has been described, the liquid chambers 502 are used in unison to eject liquid from the same liquid-ejection nozzle 504. By increasing the number of deformable beams 110 that are deformed, the amount of liquid that is ejected from the same liquid-ejection nozzle 504 within the same liquid droplet is increased.

Furthermore, this is advantageous because no other changes, besides the number of deformable beams 110 that are to be deformed, have to be made. That is, the electrostatic charge placed on each deformable beam 110, and other variables controlling the deformation of each deformable beam 110, do not have to be modified based on the number of deformable beams 110 that are to be deformed. As such, this embodiment provides an elegant way in which to control, or tune, the size of a liquid droplet ejected from the liquid-ejection nozzle 504 to which all the liquid chambers 502 are fluidically coupled. Having multiple liquid chambers 502 operating in the appropriate sequence, and multiple deformable beams 110, can also prevent liquid breakup during liquid ejection, among other advantages.

Another such advantage is that larger drop volumes can be achieved at a higher frequency than with a chamber of comparable dimensions having a single layer actuator mechanism. That is, having multiple deformable beams 110 permits tuning the resulting actuator to achieve desired drop size and drop velocity, at a desired frequency. Furthermore, the individual actuators (i.e., the individual deformable beams 110) need not be dimensionally identical. In addition, the individual liquid chambers 502 do not have to be dimensionally identical, either.

Figure 9:
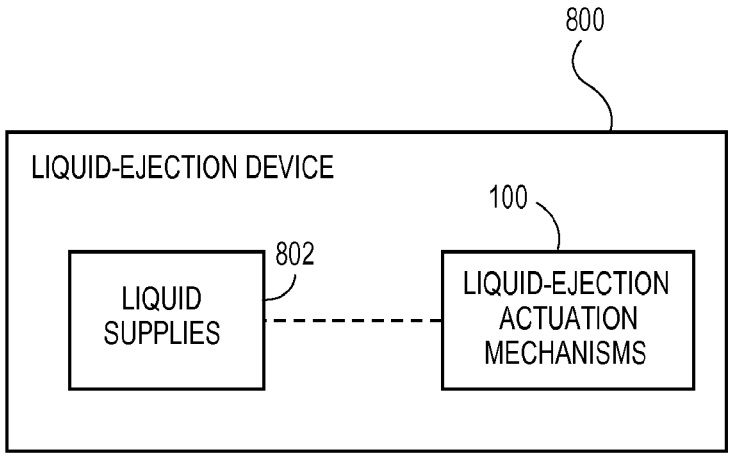
FIG. 9 is a diagram of a rudimentary electrostatic liquid-ejection device, according to an embodiment of the disclosure.

In conclusion, FIG. 9 shows a rudimentary electrostatic drop-on liquid-ejection device 800, according to an embodiment of the disclosure. The liquid-ejection device 800 is shown in FIG. 9 as including one or more liquid supplies 802, and one or more electrostatic liquid-ejection actuation mechanisms 100. The liquid-ejection device 800 can and typically does include other components, in addition and/or in lieu of the liquid supplies 802, and the actuation mechanisms 100.

The liquid-ejection device 800 may be an inkjet-printing device, which is a device, such as a printer, that ejects ink onto media, such as paper, to form images, which can include text, on the media. The liquid-ejection device 800 is more generally a liquid-jet precision-dispensing device that precisely dispenses liquid, such as ink. The liquid-ejection device 800 may eject pigment-based ink, dye-based ink, another type of ink, or another type of liquid. Embodiments of the present disclosure can thus pertain to any type of liquid-jet precision-dispensing device that dispenses a liquid.

The liquid-jet precision-dispensing device precisely prints or dispenses a liquid in that gases such as air are not primarily or substantially ejected. The terminology liquid encompasses liquids that are at least substantially liquid, but which may include some solid matter, such as pigments, and so on. Examples of such liquids include inks in the case of inkjet-printing devices. Other examples of liquids include drugs, cellular products, organisms, fuel, and so on.

The liquid supplies 802 include the liquid that is ejected by the liquid-ejection device 800. In varying embodiments, there may be just one liquid supply 802, or more than one liquid supply 802. The electrostatic liquid-ejection actuation mechanisms 100 are implemented as has been described. In varying embodiments, there may be just one electrostatic liquid-ejection actuation mechanism 100, or more than one electrostatic liquid-ejection actuation mechanism 100. The liquid supplies 802 are fluidically coupled to the liquid-ejection actuation mechanisms 100, as indicated by the dotted line in FIG. 9.

In conclusion, one specific exemplary embodiment of the present disclosure is provided. In this embodiment, there are ten actuators (i.e., ten electrostatic liquid-ejection actuation mechanisms). The liquid-ejection nozzle radius is ten microns, and the nozzle depth is twenty microns. There are further two liquid inlets, each being 20 microns in width, 26 microns in depth, and 300 microns in length. The viscosity of the liquid (e.g., ink) is 10 centipoise. The liquid chamber itself is 26 microns deep, by 1850 microns long, by 100 microns wide.

This specific exemplary embodiment provides for the following performance characteristics. Liquid drops ejected from the liquid-ejection nozzles are each 3.3 picoliters in volume, and have a speed of 8.8 meters/second. The drop emission frequency, for constant drop speed, can be zero to fifteen kilohertz. Finally, the fluidic natural resonant frequency of this embodiment of the disclosure is 70 kilohertz.

We claim:

1. An electrostatic liquid-ejection actuation mechanism comprising:

a membrane;

a frame having two sides and a plurality of cross members non-parallel to the two sides, the two sides and the cross members defining one or more areas individually corresponding to one or more liquid chambers;

one or more deformable beams disposed between the membrane and the frame, the deformable beams individually corresponding to the liquid chambers, the deformable beams defining a plurality of slits, each slit adjacent to one of the two sides of the frame, each deformable beam acting as a first electrode; and a second electrode positioned relative to the first electrode to define an electrostatic gap between the first and the second electrodes, the first and the second electrodes to temporarily maintain an electrostatic charge therebetween over the electrostatic gap wherein the deformable beams have a width less than a width of the liquid chambers, due at least to the slits.

2. The electrostatic liquid-ejection actuation mechanism of claim 1, wherein the two sides of the frame comprise a left side and a right side, and for each deformable beam the plurality of slits comprise a first slit adjacent to the left side of the frame and a second slit adjacent to the right side of the frame, wherein the width of each deformable beam is equal to a distance between the first slit for the deformable beam and the second slit for the deformable beam, and wherein the width of each deformable beam is independent of the width of each liquid chamber, due at least to the slits.

3. The electrostatic liquid-ejection actuation mechanism of claim 1, wherein the cross members are equal to two in number and comprise a top cross member and a bottom cross member, the two sides comprising a left side and a right side, and wherein the liquid chambers and the areas defined between the left side, the right side, the top cross member, and the bottom cross member are equal to one in number and comprise a single area corresponding to a single liquid chamber.

4. The electrostatic liquid-ejection actuation mechanism of claim 3, wherein the one or more deformable beams are equal to one in number and comprise a single deformable beam having a top side, a bottom side, a left side, and a right side, the top side adjacent to and attached to the top cross member, the bottom side adjacent to and attached to the bottom cross member, and wherein the plurality of slits are equal to two in number and comprise a first slit and a second slit, the first slit situated between the left side of the single deformable beam and the left side of the frame, and the second slit situated between the right side of the single deformable beam and the right side of the frame, such that the left side and the right side of the single deformable beam are unattached to the frame.

5. The electrostatic liquid-ejection actuation mechanism of claim 1, wherein the cross members are more than two in number and comprise a top cross member, a bottom cross member, and one or more middle cross members, the two side comprising a left side and a right side, and wherein the liquid chambers and the areas are equal in number to the middle cross members plus one, each area defined between the left side, the right side, and at least one of the middle cross members.

6. The electrostatic liquid-ejection actuation mechanism of claim 5, wherein the one or more deformable beams are equal in number to the liquid chambers, each deformable beam having a top side, a bottom side, a left side, and a right side, the top side adjacent to and attached to one of the cross members, the bottom side adjacent to and attached to another of the cross members, and wherein for each deformable beam the plurality of slits comprises a first slit and a second slit, the first slit situated between the left side of the deformable beam and the left side of the frame, and the second slit situated between the right side of the deformable beam and the right side of the frame, such that the left side and the right side of each deformable beam are unattached to the frame.

7. The electrostatic liquid-ejection actuation mechanism of claim 6, wherein liquid is ejectable from the liquid chambers in a coordinated manner to eject a desired single liquid droplet from the liquid chambers.

8. The electrostatic liquid-ejection actuation mechanism of claim 1, wherein the deformable beams responsive to an electrostatic charge are to deform from a first configuration to a second configuration to increase a liquid volume within the liquid chambers, and wherein the deformable beams responsive to the electrostatic charge being released are to revert from the second configuration back to the first configuration to cause liquid to be ejected from the liquid chambers.

9. The electrostatic liquid-ejection actuation mechanism of claim 1, wherein the membrane and the deformable beams are fabricated of a first material different than one or more materials from which the frame is fabricated.

10. The electrostatic liquid-ejection actuation mechanism of claim 9, wherein the first material is tantalum-aluminum.

11. An electrostatic liquid-ejection actuation mechanism comprising:

a membrane;

a frame having two sides and a plurality of cross members non-parallel to the two sides, the two sides and the cross members defining one or more areas individually corresponding to one or more liquid chambers;

one or more deformable beams disposed between the membrane and the frame, the deformable beams individually corresponding to the liquid chambers, the deformable beams defining a plurality of slits, each slit adjacent to one of the two sides of the frame, wherein the deformable beams have a width less than and independent of a width of the liquid chambers, due at least to the slits, wherein the deformable beams responsive to an electrostatic charge are to deform from a first configuration to a second configuration to increase a liquid volume within the liquid chambers, and wherein the deformable beams responsive to the electrostatic charge being released are to revert from the second configuration back to the first configuration to cause liquid to be ejected from the liquid chambers; and, a second electrode, each deformable beam acting as a first electrode, the second electrode positioned relative to the first electrode to define an electrostatic gap between the first and the second electrodes, the first and the second electrodes to temporarily maintain the electrostatic charge therebetween over the electrostatic gap.

12. An electrostatic liquid-ejection device comprising:

one or more liquid supplies; and, one or more electrostatic liquid-ejection actuation mechanisms fluidically coupled to the liquid supplies, each electrostatic liquid-ejection actuation mechanism comprising:

a membrane;

a frame having two sides and a plurality of cross members non-parallel to the two sides, the two sides and the cross members defining one or more areas individually corresponding to one or more liquid chambers;

one or more deformable beams disposed between the membrane and the frame, the deformable beams individually corresponding to the liquid chambers, the deformable beams defining a plurality of slits, each slit adjacent to one of the two sides of the frame, each deformable beam acting as a first electrode; and a second electrode positioned relative to the first electrode to define an electrostatic gap between the first and the second electrodes the first and the second electrodes to temporarily maintain an electrostatic charge therebetween over the electrostatic gap, wherein the deformable beams have a width less than and independent of a width of the liquid chambers, due at least to the slits.

13. The electrostatic liquid-ejection device of claim 12, wherein, for each electrostatic liquid-ejection actuation mechanism, the deformable beams responsive to an electrostatic charge are to deform from a first configuration to a second configuration to increase a liquid volume within the liquid chambers, and wherein the deformable beams responsive to the electrostatic charge being released are to revert from the second configuration back to the first configuration to cause liquid to be ejected from the liquid chambers.

* * * * *

UNITED STATES PATENT AND TRADEMARK OFFICE

CERTIFICATE OF CORRECTION

PATENT NO. : 8,573,747 B2
APPLICATION NO. : 13/119601
DATED : November 5, 2013
INVENTOR(S) : Adel Jilani et al.

It is certified that error appears in the above-identified patent and that said Letters Patent is hereby corrected as shown below:

In the Claims

In column 10, line 34, in Claim 12, delete “electrodes” and insert -- electrodes, --, therefor.

Signed and Sealed this
Eighteenth Day of February, 2014

Michelle K. Lee

Michelle K. Lee
*Deputy Director of the United States Patent and Trademark Office*